United States Patent [19]

Rashev et al.

[11] Patent Number: 4,476,565

[45] Date of Patent: Oct. 9, 1984

[54] METHOD AND SYSTEM FOR CONTROL OF THE ELECTROSLAG REMELTING

[75] Inventors: Tzolo V. Rashev, Sofia; Lyudmil K. Valkov, Pernik; Ivanka A. Rasheva, Sofia; Stoyan M. Stoyanov, Sofia; Danail K. Kossev, Sofia; Yordan G. Lambev, Sofia, all of Bulgaria

[73] Assignee: Institute Po Metaloznante I Technologia Na Metalite, Sofia, Bulgaria

[21] Appl. No.: 440,321

[22] Filed: Nov. 9, 1982

[51] Int. Cl.[3] ..... H05B 7/148

[52] U.S. Cl. ..... 373/50

[58] Field of Search ..... 373/49, 50, 47, 42, 373/105

[56] References Cited

U.S. PATENT DOCUMENTS

| | | | |
|---|---|---|---|
| 3,619,464 | 11/1971 | Holzgruber | 373/49 |
| 3,952,139 | 4/1976 | Burkle et al. | 373/49 |
| 4,194,078 | 3/1980 | Thomas | 373/50 |
| 4,273,948 | 6/1981 | Masucci | 373/50 |
| 4,395,771 | 7/1983 | Medovar | 373/49 |

FOREIGN PATENT DOCUMENTS 1246676 9/1971 United Kingdom .

OTHER PUBLICATIONS

Mironov, "Electroshlakov Petchi", 1978, (Electroslag Furnace).

Paton, Medovar "Electroshlakovic Petchi", Kiev, 1976.

*Primary Examiner*—Roy N. Envall, Jr.

*Attorney, Agent, or Firm*—Karl F. Ross; Herbert Dubno

[57] ABSTRACT

A method of and an apparatus for controlling an electroslag remelting furnace in which the passage of the electrode through limiting slag levels defining a no-arc zone of operation results in arcing which produces an electromagnetic emission which is detected by a separating filter and is used to control a drive for the electrode.

3 Claims, 2 Drawing Figures

METHOD AND SYSTEM FOR CONTROL OF THE ELECTROSLAG REMELTING

FIELD OF THE INVENTION

The invention relates to a method of and to a system for control of the electroslag remelting of metals and alloys at atmospheric pressure with a counter-pressure or in vacuum.

BACKGROUND OF THE INVENTION

A method for electroslag remelting is known where the values of the current and the voltage are determined in advance in order to carry out the process in a computerized way. Then the same values are specified more exactly to obtain an ingot of the metal to be remelted having defined properties.

Disadvantages of this known method are that there is no guarantee of success even in the case of a large number of experimental melts repetitious of the entire remelting process requires the expenditure of much labor and a high consumption of raw-materials.

A system for the programmed control of electroslag remelting is known (British Pat. No. 1,246,676) which operates in accordance with the known methods and comprises programmers connected with current and voltage regulators as well as with a device for determining the velocity of the electrode movement that corrects the instantanous values assigned to the current and voltage regulators. The preset values of the controlling parameter are determined in a computerized way and are specified more exactly during the experimental melts. They are given to the programmer, which is connected with the regulator of the corresponding control circuit.

A disadvantage of this known system is that it is not able to guarantee the control of the entire process in a non-arc regime of electroslag remelting because the control is carried out after a preliminary given program which on its part can not eliminate the influence of accidental factors in the electroslag remelting.

OBJECT OF THE INVENTION

It is the object of the present invention to provide a method of and a system for electroslag remelting in a non-arc regime which eliminates the accidental perturbations and the need for experimental melts for determining the operating conditions.

SUMMARY OF THE INVENTION

The object is achieved in providing a method for the control of electroslag melting which is carried out with a continuous control of the current and voltage values that are determined at a minimal intensity of electromagnetic emissions caused by electrical arc discharges.

The system for control of electroslag remelting comprises a separating filter whose input with a preamplifier is connected to the current conducting bar, whereas its output is connected through a series-connected differential amplifier and amplifier to an end step, the output of which is connected through a trigger to a regime switch, connected by an electromagnetic relay to the switch of the motor driving the electrode and a device for changing the velocity of the motor, whereby the end of the secondary winding is grounded while a condenser is included between the two ends of the secondary winding of the power transformer. In order to obtain a signal with the necessary strength in the beginning of the process, a connection is provided between the separating filter with its preamplifier and the current conducting bar to be movable.

The advantages of the method according to the invention are that it permits operation with a non-arc regime or mode for the entire process; remelting is carried out with reduced labor and raw-material cost since there is no longer a need for experimental melts. The method according to the invention allows the determining of current values close to the optimal in order to obtain an ingot with better properties. Furthermore based upon the obtained values for the current and voltage it is now possible to find for an apparatus with fixed dimensions the minimal quatity of slag needed to ensure non-arc operation of the process of electroslag remelting. An advantage of the control system of the process of non-arc electroslag remelting according to the invention is that it maintains a non-arc mode during the entire cycle of electroslag remelting which is automatic without making it necessary to have a program worked out in advance.

BRIEF DESCRIPTION OF THE DRAWING

The present invention will be described further by way of an example, with reference to the accompanying drawing, in which.

SPECIFIC DESCRIPTION

Figure 1:
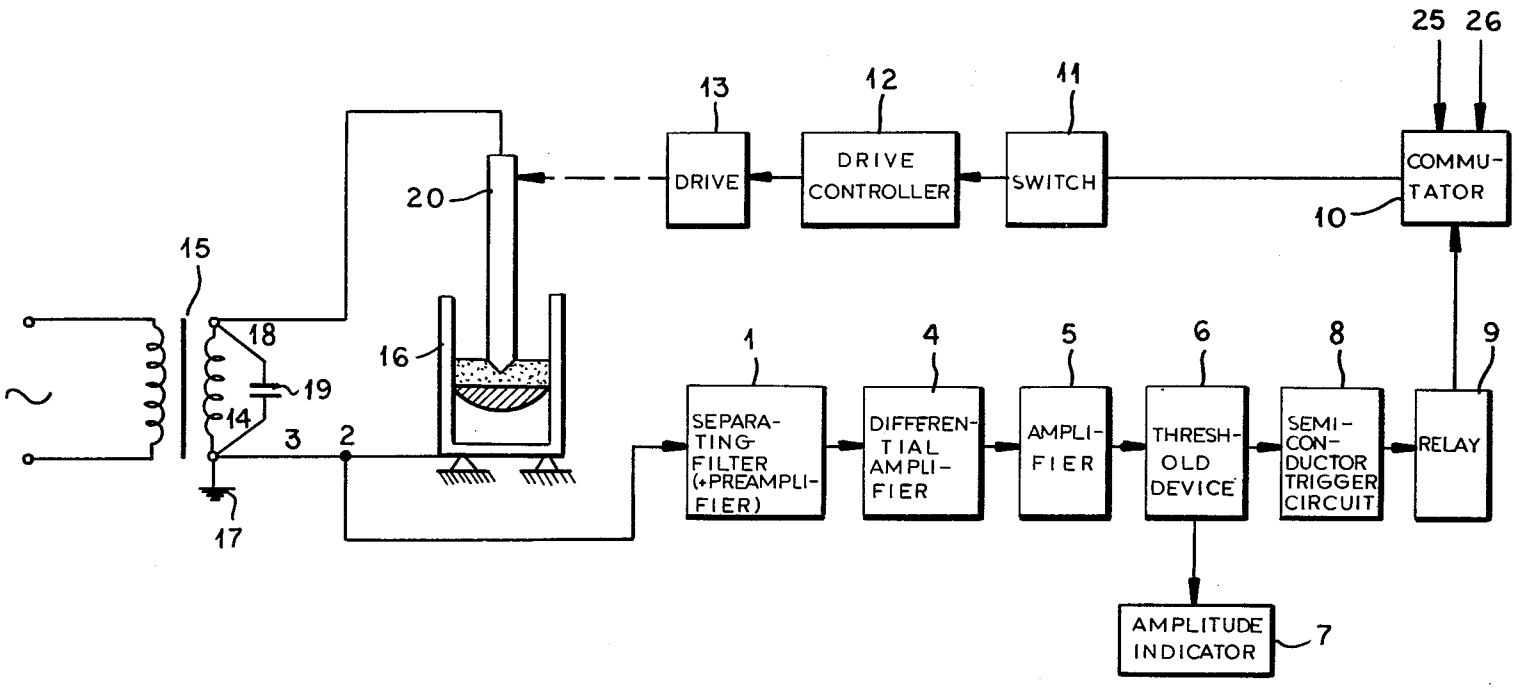
FIG. 1 represents a block-diagram of the system.

The input of the separating filter with preamplifier 1 is connected at 2 to the current conducting bar 3, while to the output are connected in succession a differential amplifier 4 an amplifier 5, a limit step threshold unit 6 with an indicator 7 for the strength of the signal received, followed by a semi-conductor trigger current 8, an electromagnetic relay 9, commutator 10, a switch 11 of the electrode driving device or controller 12 and a drive 13. The end of the secondary winding 14 of the transformer 15, leading to the electroslag remelting furnace 16 is grounded at point 17, whereas between the points 17 and 18 is included a condensor 19.

Figure 2:
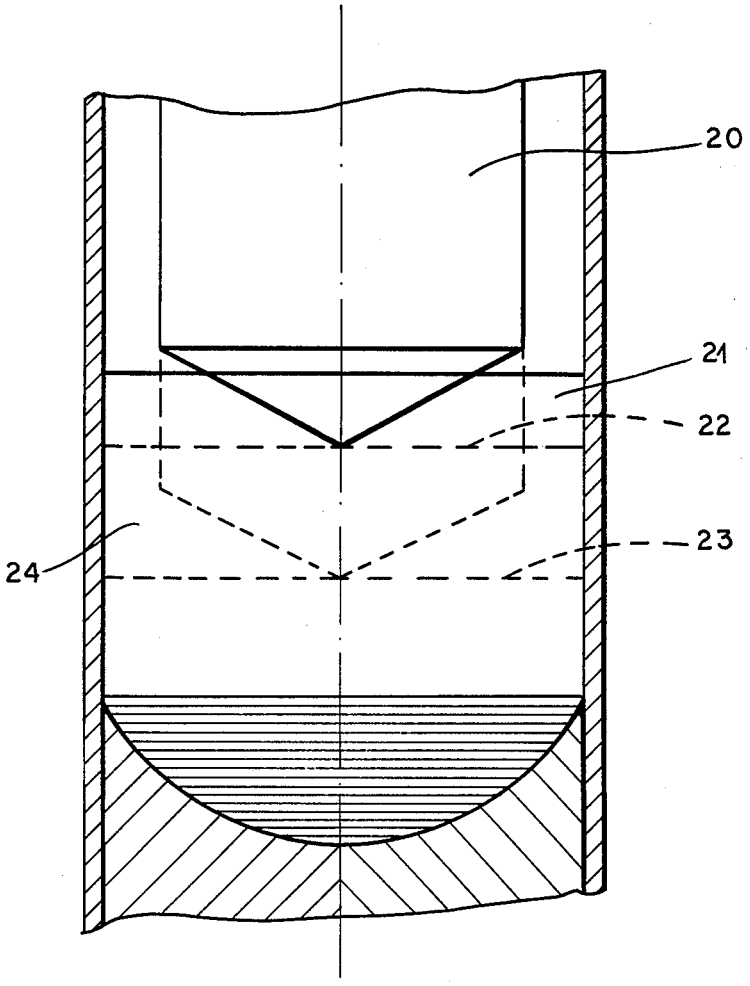
FIG. 2 shows a diagram in section of the limiting positions of the electrode in the slag bath in the case of a non-arc operating mode.

FIG. 2 shows two positions of the electrode 20 in the slag bath 21—immersed to upper limit 22 and lower limit 23 of zone 24 where the process proceeds in an non-arc mode. During the process of remelting electric arc discharges are produced when the position of the electrode is above limit 22 as well as beneath limit 23. These arc discharges are a source of electromagnetic emissions in a broad frequency range. When the tip of the electrode is in the zone 24, the arc discharges diminish to zero and so too the electromagnetic emissions decrease which is a proof that the process is proceeding in a non-arc regime. The perturbing industrial noise is led away to ground in point 17. The useful signal of the electroslag remelting process is taken from the connection 2 of the current conducting bar 3, which point is selected at a distance between point 17 and the furnace 16, where in the beginning of the process the indicator 7 shows the maximal strength of the signal. The signal from connection 2 enters the separating filter, which has a broad frequency preamplifier, this block or unit being shielded and placed as close as possible to the connection 2. The amplified signal from the preamplifier 1 is transmitted with a shielded conductor to the differential amplifier 4, permitting tuning of a range of sensitivity of the system; from the differential amplifier the signal is transmitted to the amplifier 5 in which it is amplified. The ampliefied system is then applied to the limit step or threshold device 6 to which is connected the indicator 7 for the strength of the signal thus obtained. From there the signal enters the semiconductor trigger 8, controlling the electromagnetic relay 9, transmitting impulses to the commutator 10 for tuning the operation of the system to the upper or the lower limit in the conditions of a non-arc regime. When the commutator 10 is in position 25 for operating at the upper limit of the non-arc regime, or receiving a signal for an arc process, a signal is applied to the switch 11 to increase the instantaneous velocity given by block 12 to the driving device of the electrode 13. The acceleration of the immersion of the electrode in the slag bath 21 causes it to enter the zone 24 of non-arcing operation whereby the process then proceeds in a non-arc mode and the signal to switch 11 is interrupted. A new signal is formed for decreasing the speed of immersion and when as a result of the melting of the tip of the electrode it passes over the upper limit 22 to a non-arc mode, the process is repeated. In position 26 for operation in the lower limit 23 in a non-arc mode of the commutator 10, in the case of a signal for an arc process to the switch 11 is transmitted, a signal for reducing the speed of the drive 13 and the electrode decreases its immersion beneath the lower limit 23 of the zone of non-arc regime 24. As a result the signal to the switch 11 increases the instantaneous velocity of the driving device 12 and this signal is maintained to the immersion of the electrode tip under the lower limit 23 of the zone of non-arc regime 24 until a signal for an arc process is received. In the position for a maximal productivity in a non-arc mode, the tip of the electrode 20 is always moving over the lower limit 23 of the zone of non-arc regime 24, whereas in position 25 for a minimal output it moves beneath the upper limit 22 of the zone of the non-arc mode 24.

We claim:

1. A method of controlling an electroslag remelting operation in which an electrode is lowered into a slag layer atop a metal to be mounted in an electroslag mounting furnace and an electric current is passed between said electrode and the furnace to melt the metal therein, said method comprising the steps of:

(a) detecting electromagnetic signals generated by arcing at said electrode when said electrode is above a predetermined upper limit or below a predetermined lower limit on the slag layer such that between said limits the electroslag remelting proceeds in a no-arc mode and with said electrode above and below said limits arcing the said electrode;

(b) producing a control signal upon said electromagnetic signals attaining a predetermined limiting value; and (c) actuating a drive controller for the rate of lowering of said electrode into said furnace in response to said control signal to maintain said electrode substantially between said limits.

2. An apparatus for controlling an electroslag remelting operation in which an electrode is lowered into a slag layer atop a metal to be mounted in an electroslag mounting furnace and an electric current is passed between said electrode and the furnace to melt the metal therein, said apparatus comprising:

(a) a secondary winding connected between said electrode and said furnace for passing an electroslag remelting current therethrough;

(b) a drive operatively connected to said electrode for lowering the same into said slag whereby the electroslag remelted in said furnace proceeds in a no-arc mode when said electrode is between two limiting levels of the slag layer in said furnace but arcing occurs when said electrode passes said limiting levels;

(c) a condenser connected across said secondary winding, one end of said secondary winding being grounded;

(d) a separating filter provided with a preamplifier and having an input connected between said end of said secondary winding and said furnace for detecting electromagnetic signals resulting from the development of arcing at said electrode;

(e) a differential amplifier and an amplifier connected in series to an output of said separating filter for providing a control signal from said electromagnetic signals;

(f) a threshold device connected to said amplifier and responsive to the passage of said control signal through a limiting value, a signal strength indicator being connected to said threshold device;

(g) a semiconductor trigger circuit connected to said threshold device and a relay threshold device, said semiconductor trigger circuit responding to said threshold device;

(h) a commutator connected to said relay for electronically switching the relay signal in dependence upon the limit traversed by said electrode; and (i) a switch in series with said commutator and acting upon a drive controller to control said drive and vary the speed of said electrode to maintain the same substantially between said limits.

3. The apparatus defined in claim 2 wherein the connection between said input of said separating filter and the conductor between said end of said secondary winding and said furnace is variable along said conductor.

* * * * *